US006366748B1

(12) United States Patent
Takeuchi et al.

(10) Patent No.: US 6,366,748 B1
(45) Date of Patent: Apr. 2, 2002

(54) IMAGE FORMING UNIT WITH HIGH POSITIONING AND ROTATING ACCURACY AND IMAGE FORMING APPARATUS USING THE SAME

(75) Inventors: Keizou Takeuchi, Osaka; Hiroyuki Suzuki, Nara; Shigemitsu Tani, Osaka; Noboru Katakabe, Kyoto, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/572,026

(22) Filed: May 16, 2000

(51) Int. Cl.[7] ..... G03G 15/00
(52) U.S. Cl. ..... 399/111; 399/116; 399/167
(58) Field of Search ..... 399/111, 112, 399/116, 117, 159, 167, 227

(56) References Cited

U.S. PATENT DOCUMENTS

| | | | | |
|---|---|---|---|---|
| 5,809,380 A | * | 9/1998 | Katakabe et al. | 399/227 |
| 5,903,803 A | * | 5/1999 | Kawai et al. | 399/116 |
| 5,991,574 A | * | 11/1999 | Nishimuru et al. | 399/159 |
| 6,070,030 A | * | 5/2000 | Fujishiro | 399/111 |

FOREIGN PATENT DOCUMENTS

| | | | |
|---|---|---|---|
| JP | 61-114250 | * | 5/1986 |
| JP | 4-136868 | * | 5/1992 |

* cited by examiner

*Primary Examiner*—Joan Pendegrass
(74) *Attorney, Agent, or Firm*—Merchant & Gould PC

(57) ABSTRACT

An image forming unit including a photosensitive member on the surface of which an electrostatic latent image is formed, a charger for charging the photosensitive member, a developing roller for developing the electrostatic latent image into a visible image, a box for supporting the photosensitive member, the charger and the developing means. A first flange that is integrally formed into one unit including a first taper hole portion that is a positioning part with respect to the apparatus main body for positioning the photosensitive member at the image forming position of the apparatus main body and a first coupling portion that is a rotation engaging portion for receiving a rotation driving force from the apparatus main body is attached to one end of the photosensitive member. Thereby, it is possible to realize an image forming unit having a simple structure, capable of being reduced in size and weight, and realizing a high quality image, and an image forming apparatus capable of improving the positioning and the rotating accuracy of the photosensitive member at the image forming position by using the image forming unit.

13 Claims, 8 Drawing Sheets

IMAGE FORMING UNIT WITH HIGH POSITIONING AND ROTATING ACCURACY AND IMAGE FORMING APPARATUS USING THE SAME

FIELD OF THE INVENTION

The present invention relates to an image forming apparatus applicable as, for example, a color printer, a color copying machine, a color facsimile, and the like, and in particular, to a color electrophotographic apparatus forming a color image by using electrophotography and to an image forming unit used therefor.

BACKGROUND OF THE INVENTION

FIG. 7 is a cross-sectional view showing a conventional image forming unit taken along a plane through its center. The image forming unit shown in FIG. 7 includes a photosensitive member, a charger, a developing means, a cleaning means, a box, and the like.

In FIG. 7, numeral 100 denotes an image forming unit, which is formed integrally as one unit including a photosensitive member 110 and process elements provided therearound. Each element includes the following parts.

Numeral 121 denotes a charger for homogeneously charging the photosensitive member 110, and 123 denotes a developing means including a developing roller 122. Numeral 125 denotes a toner hopper containing toner 124. The toner 124 is supported on the surface of the developing roller 122 of the photosensitive means 123 and develops the photosensitive member 110. Numeral 126 denotes a cleaning means for removing toner remaining on the surface of the photosensitive member 110, which includes a rubber cleaning blade 127 and a waste toner case 128 for containing waste toner. Numeral 129 denotes an exposure window opening for a laser beam to enter the image forming unit 100.

FIG. 8 is a perspective view showing a drive side flange of the photosensitive member with which a gear for driving to rotate the photosensitive member is integrated.

As shown in FIG. 8, at one end of the photosensitive member 110, the drive side flange 111 is fixed. The drive side flange 111 is formed integrally into one unit with a gear portion 111A receiving a rotation driving force from the apparatus main body. On the other end of the photosensitive member 110 opposing to the drive side flange 111, a non-drive side flange (not shown) is fixed. The photosensitive member 110 is held in a box 130 by a photosensitive member axis 112 supporting while rotating each flange attached to the photosensitive member 110 at the axis of the photosensitive member 110. Furthermore, the photosensitive member 110 is positioned at the image forming position of the apparatus main body at both ends of the photosensitive member axis 112. Moreover, numeral 131 denotes washers provided at both ends of the photosensitive member 112 so that the photosensitive member axis 112 is not prevented from dropping from the box 130. Furthermore, at the drive side flange 111, a metal plate 113 is provided in contact with both the photosensitive member 110 and the photosensitive member axis 112 so that the photosensitive member 110 conducts to the apparatus main body.

Also in a color printer, a color copying machine, a color facsimile, and the like, similar to monochrome ones, there is a demand towards a high quality image, small size and low cost by producing the image forming apparatus by forming each image forming member as one unit, thus facilitating the handling. Above all, in order to improve the image quality, it is required to improve the positioning accuracy and the rotating accuracy of the photosensitive member of each image forming unit in the photosensitive member at the image forming position.

SUMMARY OF THE INVENTION

It is an object of the present invention to provide an image forming unit having a simple structure, capable of reduction in size and weight, and realizing a high quality image, and an image forming apparatus capable of improving the positioning and the rotating accuracy of the photosensitive member at the image forming position by using the image forming unit.

In order to attain the above-mentioned object, an image forming unit according to the present invention includes a photosensitive member on the surface of which an electrostatic latent image is formed; a charger for charging the photosensitive member; a developing means for developing the electrostatic latent image into a visible image; and a box for supporting the photosensitive member, the charger and the developing means; and wherein a first flange that is integrally formed into one unit including a positioning part with respect to the image forming apparatus main body for positioning the photosensitive member at the image forming position of the image forming apparatus main body and a rotation engaging portion for receiving a rotation driving force from the image forming apparatus main body is attached to at least one end of the photosensitive member. According to this configuration of the image forming unit, it is possible to lighten and simplify the photosensitive member, to support the photosensitive member axis by the image forming apparatus main body, and to rotate the photosensitive member easily by the axis itself. Therefore, positioning accuracy and rotating accuracy of the photosensitive member are improved. As a result, it is possible to align colors accurately, which is important when forming a color image. Thus, a high quality image can be obtained.

Furthermore, it is preferable in the image forming unit according to the present invention that the positioning part is a hole or a concave portion provided concentrically with respect to the photosensitive member axis. According to such a preferable configuration, it is possible to guide the positioning means of the image forming apparatus main body to the positioning part easily and to carry out the positioning by the photosensitive member axis. As a result, it is possible to reduce rocking in rotation of the photosensitive member at the time of rotation driving, and thus a high quality image can be obtained.

Furthermore, it is preferable in the image forming unit according to the present invention that a second flange that is integrally formed into one unit including a positioning part for positioning with respect to the image forming apparatus main body is attached to the other end of the photosensitive member opposing the first flange. According to such a preferable configuration, it is possible to simplify the structure of the photosensitive member. Furthermore, since the positioning parts of both of the first flange and the second flange with respect to the image forming apparatus main body are provided in the flange main body, the photosensitive member can be positioned at the image forming position of the image forming apparatus main body at high accuracy. Furthermore, in this case, it is preferable that the second flange is provided with a rotation engaging portion for conveying the rotation driving force from the image forming apparatus main body. According to such a preferable configuration, since it is possible to convey the rotation driving force of the photosensitive member to the positioning means of the image forming apparatus main body that engages the second flange, the positioning means is allowed to rotate together with the second flange so as to inhibit the sliding between the rotation engaging portion of the second flange and the positioning means. As a result, it is possible to prevent the positioning part of the second flange from being deformed and, at the same time, to prevent mislocation in positioning the photosensitive member, and a high quality image can be obtained. Furthermore, in this case, it is preferable that both ends of the photosensitive member are rotatably bearing supported by the box in the outer circumference of the first and second flanges. According to such a preferable configuration, it is possible to use the side face of the flange effectively. In particular, by positioning the photosensitive member at the axis of the photosensitive member of each flange, the rotation accuracy of the photosensitive member can be increased. Thus, the accuracy in aligning colors can be enhanced, thus to obtain a high quality image. Furthermore, it is preferable in this case that the bearing supporting portions for supporting the first and second flanges formed in the box are formed in approximately U-shaped grooves having a thickness that is larger than an outer diameter of the part of the first and second flanges that is bearing supported. According to such a preferable configuration, it is possible to attach/detach the photosensitive member to/from the box easily.

Furthermore, it is preferable in the image forming unit according to the present invention that at least one of the first flange and the second flange is made of a conductive material. According to such a preferable configuration, conduction to the image forming apparatus main body can be taken simply without using an additional component for conducting to the image forming apparatus main body in the photosensitive member. Furthermore, since there is no load due to the sliding friction of the component for conducting to the image forming apparatus main body, it is possible to enhance the rotation accuracy of the photosensitive member.

Furthermore, it is preferable in the image forming unit according to the present invention that the rotating engaging portion of the first flange is a concave and convex surface formed on one end face of the first flange and the concave and convex surface is located at the outer-most side portion. According to such a preferable configuration, the moving amount of the rotation driving means of the image forming apparatus main body can be reduced, thus to realize the miniaturization of the image forming apparatus main body. Furthermore, in this case, it is preferable that the image forming unit further includes a cover that has substantially the same height as the rotation engaging portion of the first flange and protects the first flange. According to such a preferable configuration, since it is possible to protect the entire part of the flange outer circumference of the bearing supported flange and the rotation engaging portion, it is possible to prevent the positioning part, rotation engaging portion, and bearing supported outer circumference from being damaged due to impact from the outside.

Furthermore, an image forming apparatus according to the present invention includes a plurality of image forming units for different colors having a photosensitive member; an image forming unit conveying means for switching the plurality of image forming units by moving them successively between an image forming position and a waiting position; a positioning means for positioning the photosensitive member at a predetermined image forming position; an exposure means for exposing the photosensitive member; a transfer means for transferring sequentially the toner images of many colors, which are formed on the photosensitive member, to form a toner image in which toner images of a plurality of colors are overlapped on the photosensitive member, and a rotation driving means for driving to rotate the photosensitive member and the transfer means; and wherein an image forming unit according to the present invention is used as the image forming unit. According to this configuration of the image forming apparatus, it is possible to realize an image forming apparatus capable of positioning the photosensitive member at the image forming position of the image forming apparatus main body at high accuracy and at the same time of driving to rotate the photosensitive member at high accuracy. As a result, a high quality image can be obtained.

Furthermore, it is preferable in the image forming apparatus according to the present invention that at least one of the positioning means and the rotation driving means is made of a conductive material that is in contact with and conducts to the first flange or second flange. According to such a preferable configuration, conduction to the photosensitive member can be taken simply and easily without using additional component.

Furthermore, it is preferable in the image forming apparatus according to the present invention that a brake means for providing the photosensitive member with a braking power via the second flange is further included. According to such a preferable configuration, it is possible to suppress the change in rotation of the photosensitive member when the photosensitive member is rotated by the rotation driving force of the developing roller that is in contact with the photosensitive member when the photosensitive member is rotating. Therefore, the rotating accuracy of the photosensitive member can be improved. As a result, a high quality image can be obtained.

DETAILED DESCRIPTION OF THE INVENTION

Hereinafter, the present invention will be described by way of embodiments with reference to drawings.

First, the entire configuration and operation of the color image forming apparatus of one embodiment according to the present invention will be described with reference to FIG. 1.

[Structure of the Entire Apparatus]

(Carriage)

Figure 1:
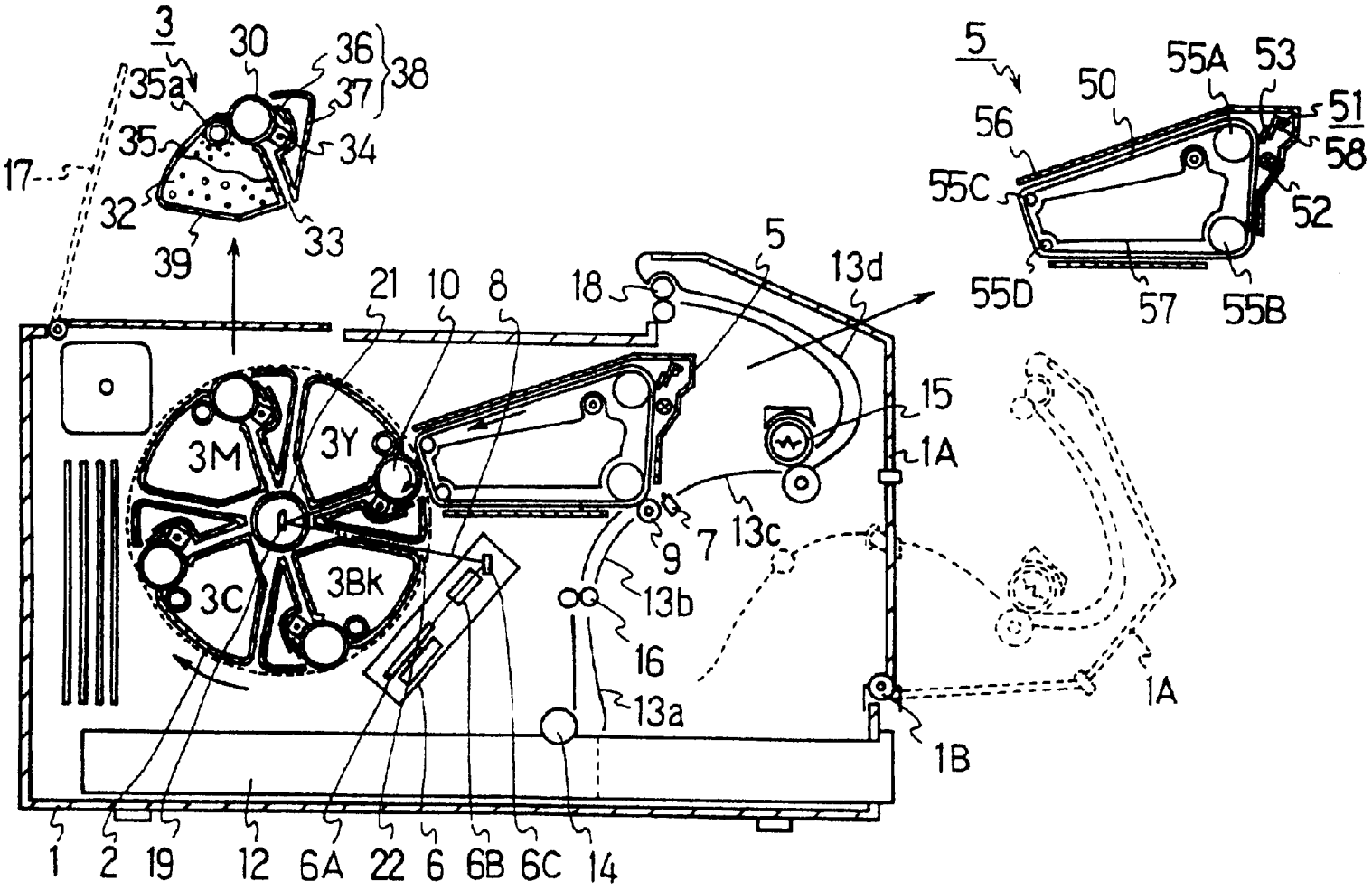
FIG. 1 is a cross-sectional view showing an overall configuration of an image forming-apparatus in one embodiment according to the present invention.

In FIG. 1, the right-hand face is the front face of the apparatus. The apparatus main body 1 includes a carriage 2 at approximately the center thereof, a front alligator 1A on the front face and a top door 17 on a top face.

The carriage 2 contains four image forming units 3Y, 3M, 3C and 3Bk for four colors (yellow, magenta, cyan and black). The carriage 2 is supported on a cylindrical drum 21 rotatably, thereby switching the image forming units 3 by sequentially shifting a photosensitive member 30 of the image forming units 3 for each color between an image forming position 10 and other waiting positions.

The image forming unit 3 is attached to the apparatus main body 1 detachably. When one of the image forming units 3 needs to be replaced with a new unit, it can be done after rotating the carriage 2 so that the image forming unit 3 of the color to be replaced is located underneath the top door 17, and opening the top door 17.

Inside the carriage 2, the image forming unit 3 can form images only at the image forming position 10 where the photosensitive member 30 is irradiated with a laser beam 8 and a transfer belt unit 5 is in contact with the photosensitive member 90. The image forming unit 8 is connected to a driving source or a power source of the apparatus main body 1 at the image forming position 10, thereby performing the image forming operation. The other positions are waiting positions in which the image forming units 3 are not operated.

(Alligator, Attachment of Transfer Belt Unit, and Treatment of Paper Jamming)

The front alligator 1A is hinged to the apparatus main body 1 with a hinge axis 1B, and can be lowered and opened toward the front. The front alligator 1A is provided with a fixing device 15, a secondary transfer roller 9, an electricity-removing needle 7, a front side of paper guide 13*a,* 13*b,* 13*c* and 13*d,* and a front side of a resist roller 16. When the front alligator 1A is lowered toward the front, these components also are lowered toward the front together. Therefore, it is possible to open the front surface of the apparatus main body 1 widely and to attach/detach the transfer belt unit 5 into/from this opened part. At the same time, it is possible to remove paper easily at the time of paper jamming.

The transfer belt unit 5 is positioned reliably at a predetermined position when it is attached to the apparatus main body 1, and the portion facing the photo sensitive member 30 at the image forming position 10 of the intermediate transfer belt 50 is in contact with the photosensitive member 30. Furthermore, at the same time, each portion of the transfer belt unit 5 is electrically connected to the side of the apparatus main body 1 and the driving pulley 55A is connected to the driving means at the side of the apparatus main body 1. Thereby, the intermediate transfer belt 50 can be rotated.

Furthermore, the electricity-removing needle 7 prevents a toner image from being disturbed when the recording paper is separated from the intermediate transfer belt 50.

(Optical System)

Numeral 6 denotes a laser exposure device, which is placed underneath the transfer belt unit 5. The laser exposure device 6 includes a semiconductor laser (not shown), a polygon mirror 6A, a lens system 6B, a first mirror 6C, and the like. The pixel laser signal light 8 corresponding to a transient serial electrical pixel signal for image information passes through an optical window 22 formed between a waste toner container 37 of the yellow image forming unit 3Y and the toner hopper 39 of the black image forming unit 3Bk. The pixel laser signal light 8 passes through a window (not shown) that is opened in a part of the cylindrical drum 21; is incident on a mirror 19 of the cylinder drum 21 (the mirror 19 is fixed to the apparatus main body 1); and is reflected from the mirror 19 and incident into the yellow image forming unit 3Y from an exposure window of the image forming unit 3Y located at the image forming position 10. Then, the pixel laser signal 8 is incident into an exposure portion of the left side face of the photosensitive member 30, and the photosensitive member 30 is exposed to light by scanning in the direction of the main line.

(Paper Feed System)

Numeral 12 denotes a paper feed unit, 14 denotes a paper feed roller, 16 denotes a resist roller, 18 denotes a paper ejecting roller, and 13*a,* 13*b,* 13*c* and 13*d* denote a paper guide, respectively, which link between the above-mentioned rollers as well as between the contact point of the intermediate transfer belt 50 and the secondary transfer roller 9 and the fixing device 15.

[Operation of the Apparatus]

The following is a description of the color image formation process.

When the transfer belt unit 5 and all image forming units 3 are installed in their predetermined locations, the power for the apparatus main body 1 is turned on, and the fixing device 15 is heated up, while the polygon mirror 6A of the laser exposing device 6 starts to be rotated, thus completing the preparations.

After these preparations are completed, first, an initialization operation is performed to move the image forming unit 3 of the color to be recorded to the image forming position 10. In this initialization operation, the carriage 2, on which all image forming units 3 are attached, rotates, and the image forming unit 3 of the color to be recorded first (in the present embodiment, the yellow image forming unit 3Y) is moved into the image forming position 10 in the apparatus main body 1, and it stops there.

First of all, an image formation process by the yellow image forming unit 3Y, which is positioned at the image forming position 10, starts. The driving source at the apparatus main body 1 starts to rotate the yellow photosensitive member 30 at the image forming position 10, and at the same time, a developing device 35, a charger 34 and an intermediate transfer belt 50 start to operate as well. Furthermore, the driving pulley 55A is driven by the driving source of the apparatus main body 1, and its friction forces rotate the intermediate transfer belt 50 in the arrow direction of FIG. 1. Herein, a peripheral speed of the photosensitive member 30 and that of the intermediate transfer belt 50 are set to be substantially the same. Furthermore, at this time, the secondary transfer roller 9 and the cleaner 51 are separated from the intermediate transfer belt 50.

In accordance with the timing with which a portion that is charged homogeneously by the charger 34 on the surface of the photosensitive member 30, a detection means (not shown), for detecting the top position of the intermediate transfer belt 50, detects the top position of the intermediate transfer belt 50. In synchronization with this detected signal, the homogeneously charged photosensitive member 30 is irradiated with a laser beam 8, which corresponds to the image signal, from the laser exposing device 6, forming the electrostatic latent image on the photosensitive member 30. The thus formed latent images are developed sequentially by the developing unit 35 so as to form into toner images. Next, the toner images formed on the photosensitive member 30 are moved toward the primary transfer position while being in contact with the intermediate transfer belt 50, and transcribed sequentially on the intermediate transfer belt 50. The yellow image forming operation is completed after the end of the image is transferred onto the intermediate transfer belt 50, and the photosensitive member 30 and the intermediate transfer belt 50 stop at the initial position.

Moreover, at the time of image formation, the photosensitive member 30 is charged to −450V by the charger 34. The exposure potential of the photosensitive member 30 becomes −50V. Furthermore, a DC voltage of +100 V is applied from a high-voltage source to the developing roller 35A (see FIG. 2) when it passes through a region of the photosensitive member 30 that is not yet charged. Furthermore, a DC voltage of −250 V is applied from the high-voltage source to the developing roller 35A when the surface of the photosensitive member 30, onto which the electrostatic latent image has been inscribed, passes the developing roller 35A. Furthermore, a DC voltage of +1.0 kV is applied to the guide pulley 55C and the tension pulley 55D of the intermediate transfer belt 50.

Yellow image forming is completed and the operation of the photosensitive member 30 and the intermediate transfer belt 50 stops, the engagement between the yellow photosensitive member 30 and the driving source of the apparatus main body 1 is released, and then the carriage 2 rotates only 90° in the arrow direction of FIG. 1. This moves the yellow image forming unit 3Y away from the image forming position 10, and the next, the magenta image forming unit 3M, is positioned and stops at the image forming position 10. When the magenta image forming unit 3M stops at the image forming position 10, the driving source of the apparatus main body 1 engages the photosensitive member 30, and the image forming unit 3M and the transfer belt unit 5 start to operate, and an image forming operation is performed, similarly as for yellow. Consequently, a magenta toner image is formed overlapping a yellow toner image on the intermediate transfer belt 50.

Thus, sequential switching operations and image forming operations are repeated for cyan and black, so that four toner images are formed on the intermediate transfer belt 50.

When the top of the black toner image, transferred by primary transfer, comes to the position of the secondary transfer roller 9, the secondary transfer roller 9 is moved. Then, recording paper, which is fed from the paper feed unit 12, is sandwiched and conveyed between the secondary transfer roller 9 and the intermediate transfer belt 50, and the four-color toner image is transferred in one batch onto the recording paper. During this time, a voltage of +300V is applied to the secondary transfer roller 9. The toner image transferred onto the recording paper is fixed on the recording paper by passing the fixing device 15, and is ejected out of the apparatus with the paper eject rollers 18.

Any toner remaining on the intermediate transfer belt 50 after secondary transfer is scraped off by the cleaning blade 53 that is brought into contact with the intermediate transfer belt 50 before the top of the image comes to the cleaning position. The scraped toner is contained in a waste toner case 57 by means of a screw 52.

When the secondary transfer is finished, the intermediate transfer belt 50 and the image forming unit 3 stop again, and the carriage 2 rotates 90°. Then, the yellow image forming unit 3Y reaches the image forming position 10, thus completing the color image forming operation.

In the above-mentioned embodiment, the secondary transfer may be carried out during the recording of the last black toner and may be carried out by rotating the intermediate transfer belt 50 after recording black.

(Image Forming Unit)

Figure 2:
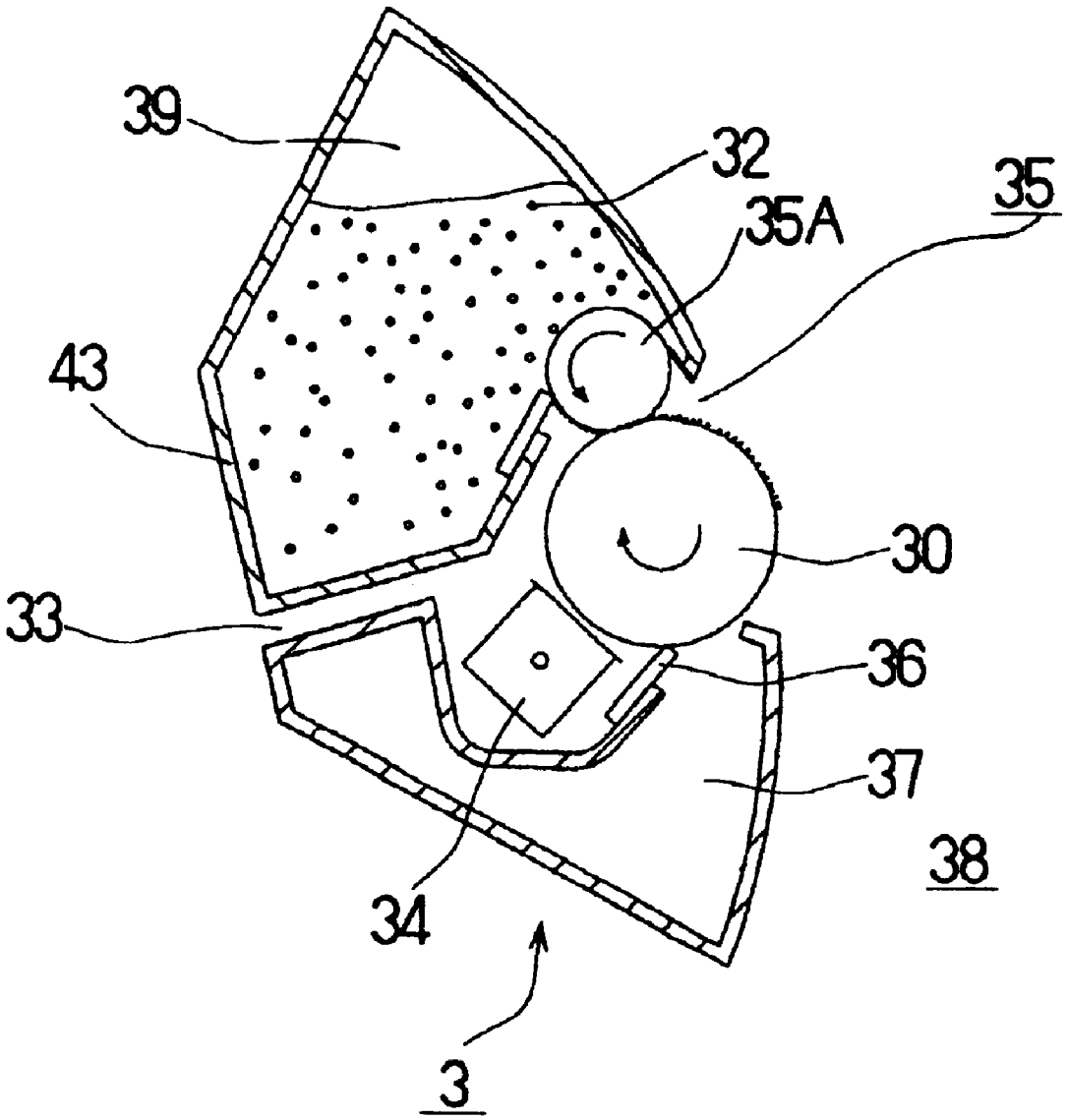
FIG. 2 is a cross-sectional view showing an image forming unit, which is formed integrally as one unit including a photosensitive member and process elements provided therearound in one embodiment according to the present invention.
Figure 3:
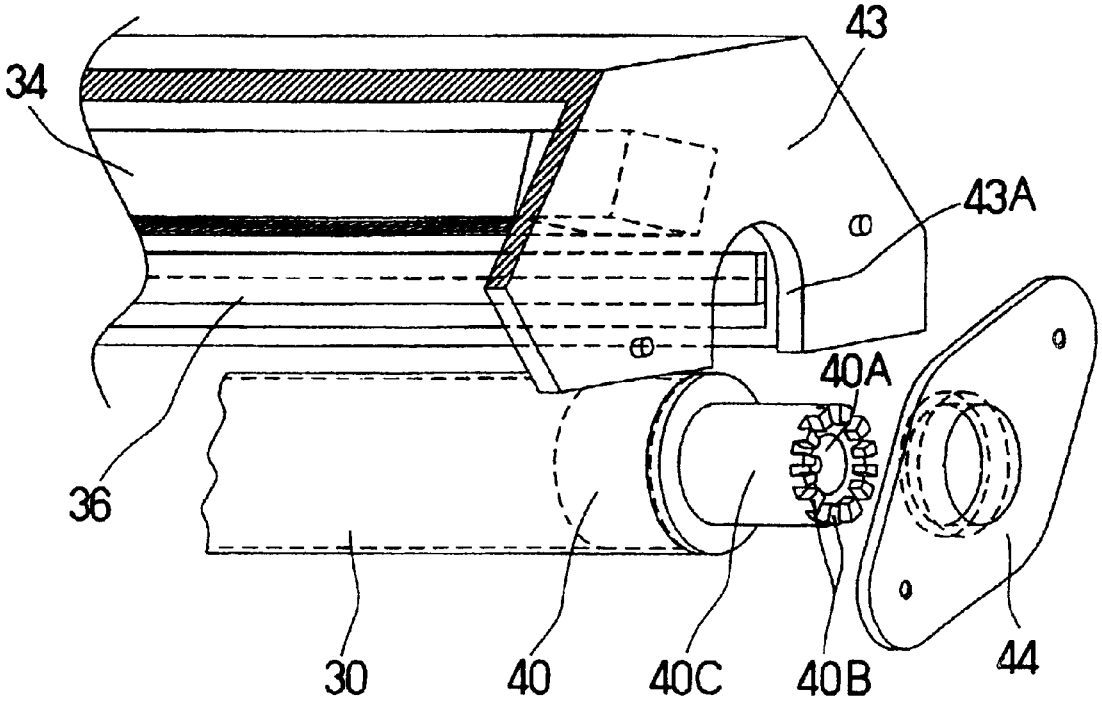
FIG. 3 is a perspective view showing a first flange in which a first taper hole portion, which is provided in the center of the flange, for positioning with respect to the apparatus main body, and a first coupling portion for rotating the photosensitive member by receiving the rotation driving force from the apparatus main body are formed into one unit in one embodiment according to the present invention.
Figure 4:
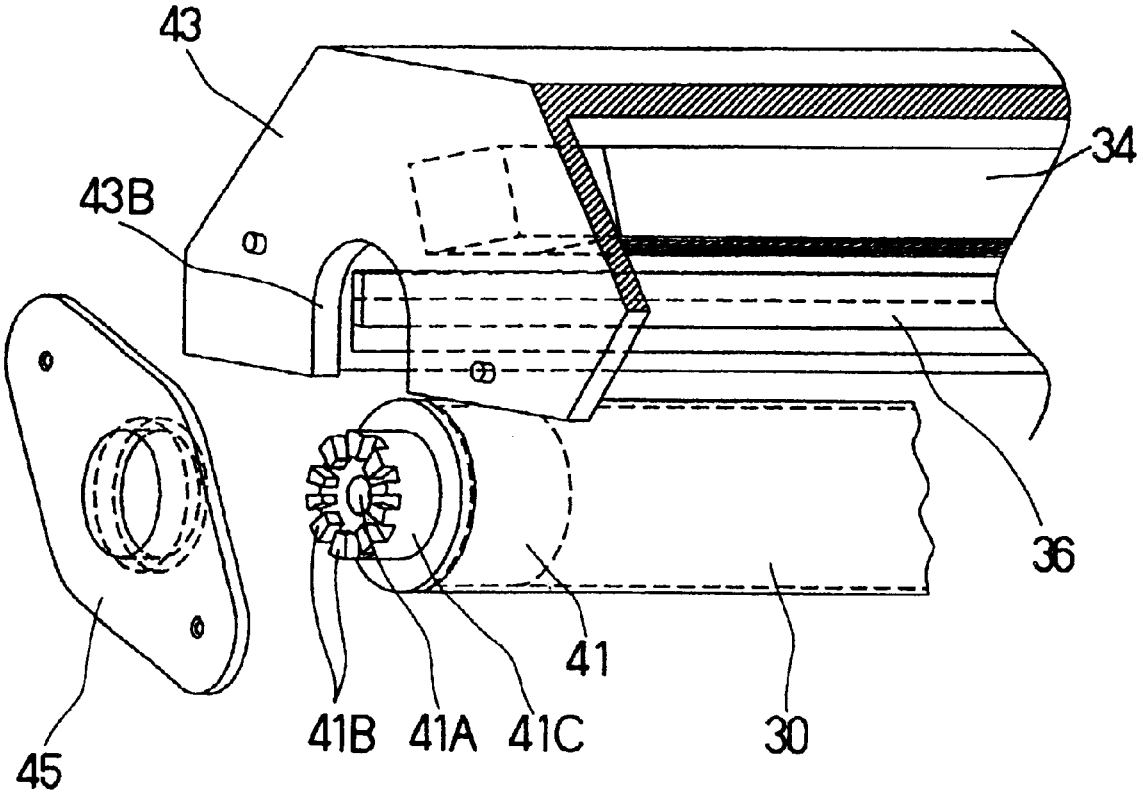
FIG. 4 is a perspective view showing a second flange in which a second taper hole portion, which is provided in the center of the flange, for positioning with respect to the apparatus main body, and a second coupling portion conveying the rotation force of the photosensitive member to the brake means of the apparatus main body are formed into one unit in one embodiment according to the present invention.

The following is a description of the configuration of an image forming unit according to the present invention with reference to FIGS. 2 to 4.

FIG. 2 is a cross-sectional view showing an image forming unit, which is formed integrally as one unit including a photosensitive member and process elements provided therearound. FIG. 3 is a perspective view showing a first flange in which a first taper hole portion, which is provided in the center of the flange, for positioning with respect to the apparatus main body, and a first coupling portion for rotating the photosensitive member by receiving the rotation driving force from the apparatus main body are formed into one unit. FIG. 4 is a perspective view showing a second flange in which a second taper hole portion, which is provided in the center of the flange, for positioning with respect to the apparatus main body, and a second coupling portion conveying the rotation force of the photosensitive member to the brake means of the apparatus main body are formed into one unit.

In FIG. 2, numeral 34 denotes a corona charger for homogeneously charging the photosensitive member 30 negatively, 35 denotes a developing device including a developing roller 35A, and 39 denotes a toner hopper. The toner hopper 39 contains negatively charged toner 32 that is made of polyester resin in which a pigment is dispersed.

The developing roller 35A supporting toner 32 on its surface is rotated in the arrow direction at the rotation speed faster than that of the photosensitive member 30 while being in contact with the photosensitive member 30, thus developing the photosensitive member 20. Numeral 8 denotes a cleaning means for cleaning off the toner remaining on the surface of the photosensitive member 30 after transfer. The cleaning means 38 includes a rubber cleaning blade 36 and a waste toner case 37 for containing waste toner. Numeral 33 denotes an exposure window by which a laser beam can enter the image forming unit 3. The diameter of the photosensitive member 30 is 30 mm, and the diameter of the developing roller 35A of the developing device 35 is about 16 mm. They are rotatably supported by the box 43 of the image forming unit 3, respectively.

Figure 5:
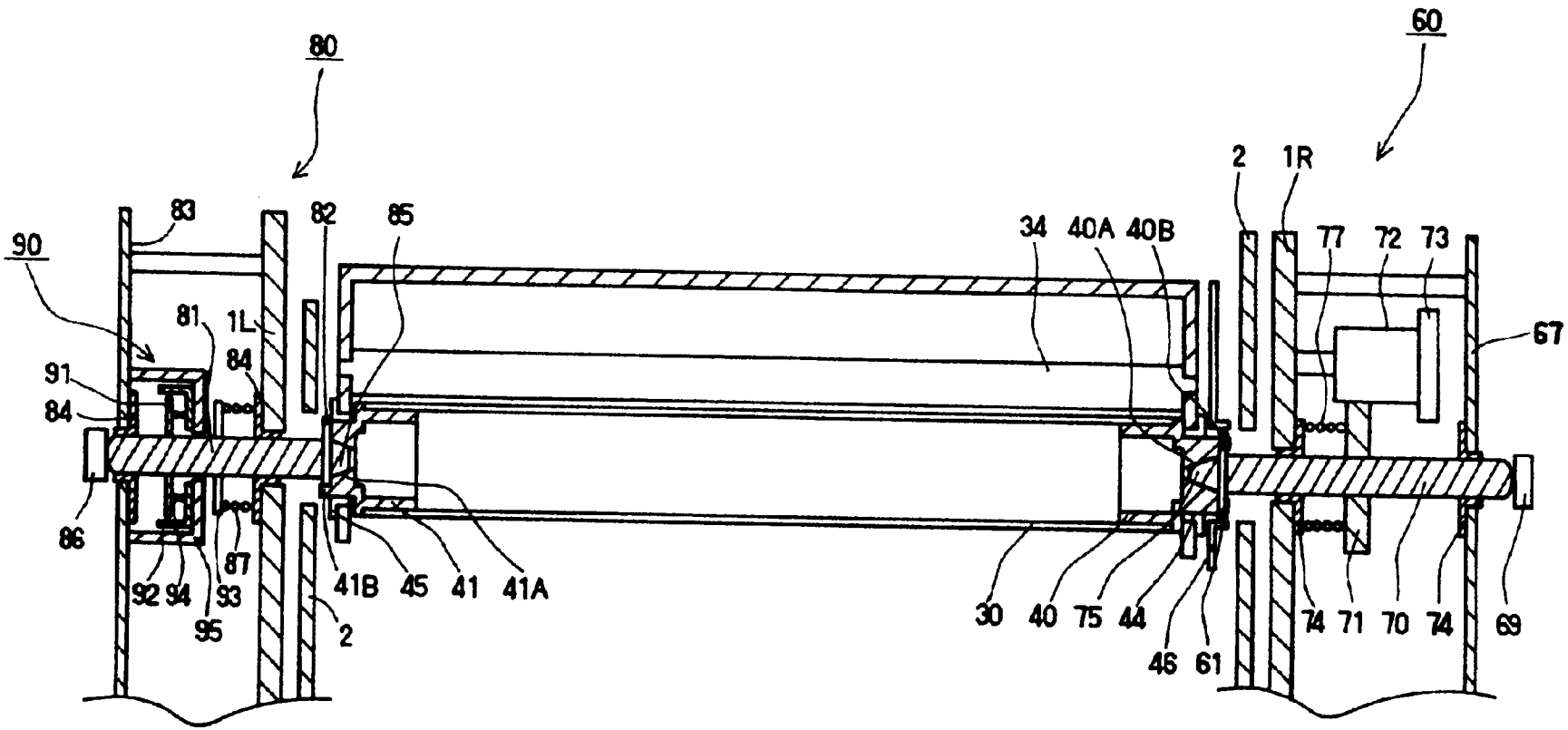
FIG. 5 is a cross-sectional view showing a state in which the image forming unit and driving mechanism are cut off at the image forming position in one embodiment according to the present invention.

As shown in FIGS. 3 to 5, the first flange 40 is fixed to the end face, which is driven to be rotated by the apparatus main body 1, of the photosensitive member 30 of the image forming apparatus 3. And the second flange 41 is fixed to another end face. The photosensitive member 30 of the image forming unit 3 is supported rotatably in which a bearing support surface 40C of the first flange 40 and a bearing support surface 41C of the second flange 41 are inserted into bearings 44 and 45 in a state in which the bearing support surfaces 40C and 41C are arranged in a flange bearing portions 43A and 43B formed in the box 43 of the image forming unit 3. The flange bearing portions 43A and 43B are formed in an approximately U shape having a diameter that is larger than that of the bearing support surface 40C of the first flange 40 and the bearing support surface 41C of the second flange 41. Thus, the photosensitive member 30 can be attached/detached to/from the apparatus main body easily.

At another end portion opposite to the photosensitive member 30 of the first flange 40, a first taper hole portion 40A, which is a positioning part for positioning the photosensitive member 30 at the image forming position 10 of the apparatus main body 1, is formed. Around the first taper hole portion 40A, the first coupling portion 40B including twelve concave and convex surfaces is formed. The first coupling portion 40B is formed as one unit with the first taper hole portion 40A. Consequently, when the first coupling portion 40B is rotated, the photosensitive member 30 is also rotated.

At another end portion opposite to the photosensitive member 30 of the second flange 41, the second taper hole portion 41A, which is a positioning part for positioning the photosensitive member 30 at the image forming position 10 of the apparatus main body 1, is formed. Around the second taper hole portion 41A, the second coupling portion 41B including ten concave and convex surfaces is formed. The second coupling portion 41B is formed as one unit with the second taper hole portion. Consequently, when the photosensitive member 30 is rotated, the second flange 41 is rotated, thus rotating the brake means of the apparatus main body 1.

Furthermore, at least one of the first flange 40 and the second flange 41 is made of a conductive material. Furthermore, at the side face of the first flange 40 side, a side cover 46 covering the entire surface of the first flange 40 is provided.

(Photosensitive Member Positioning and Rotation Driving Mechanism)

Figure 6:
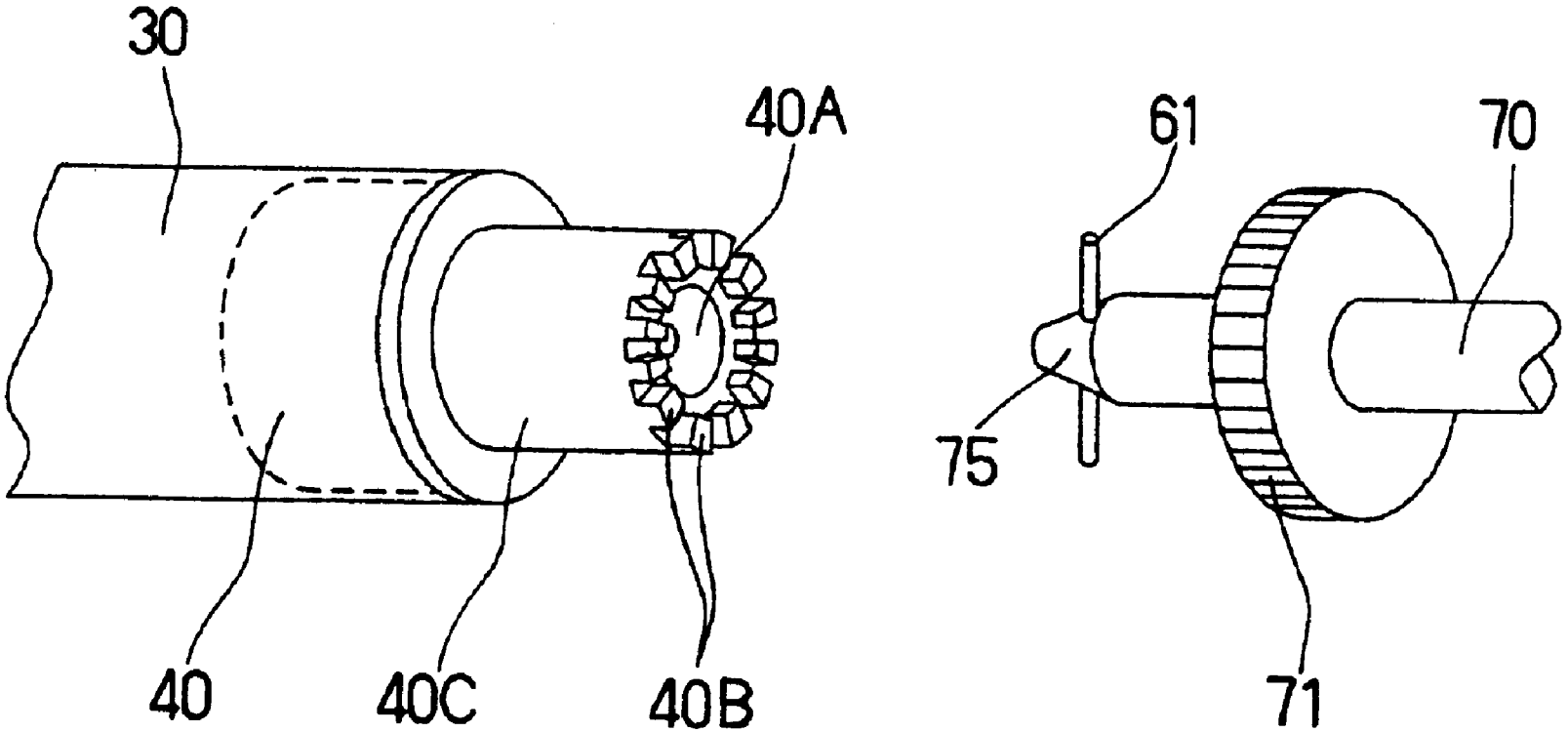
FIG. 6 is a perspective view showing a drive side flange and a photosensitive member positioning and rotation driving mechanism of the image forming unit in one embodiment according to the present invention.
Figure 7:
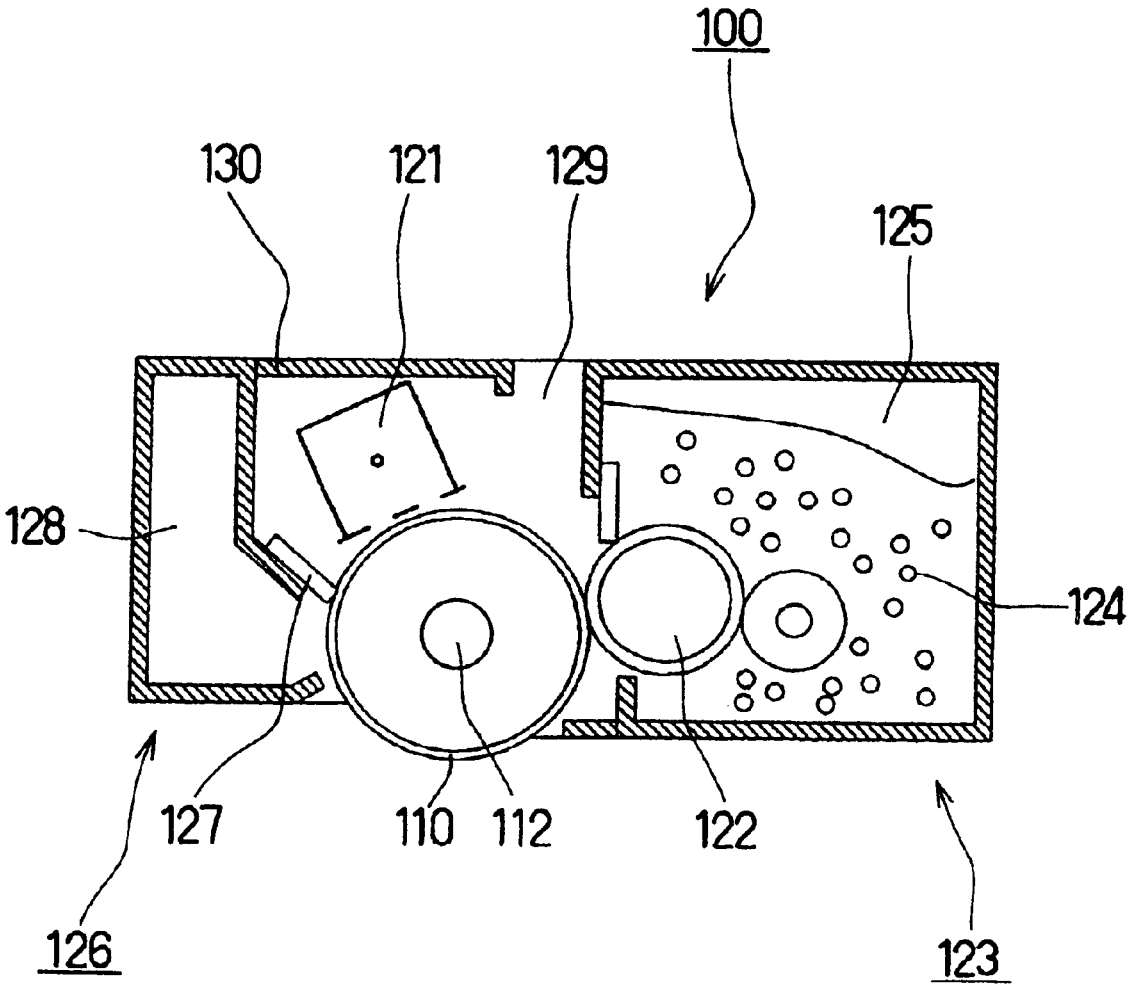
FIG. 7 PRIOR ART
FIG. 7 is a cross-sectional view showing a conventional image forming unit which is cut at its center.
Figure 8:
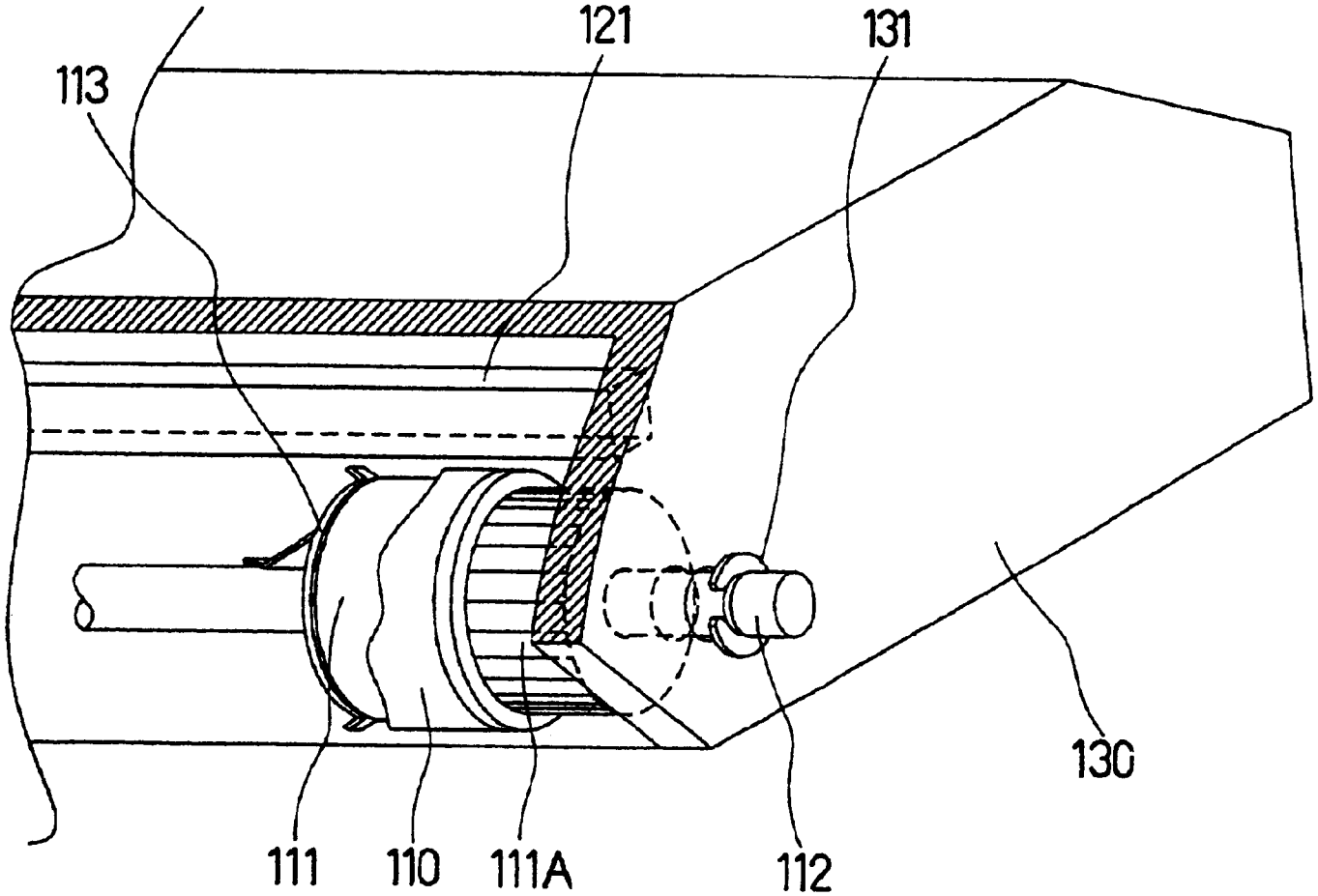
FIG. 8 PRIOR ART
FIG. 8 is a perspective view showing a conventional drive side flange in which a positioning part and a gear portion of the image forming unit are integrally formed into one unit.

The following is a detailed description of a positioning mechanism and a rotation driving mechanism for performing precise color alignment of all colors at the image forming position, with reference to FIGS. 5 and 6. FIG. 5 is a cross-sectional view showing an image forming unit taken on line passing the image forming position. FIG. 6 is a perspective view showing a first flange having an output axis and driving pin for conveying the rotation driving force from the apparatus main body to the photosensitive member and a first coupling portion.

First, rotation driving mechanisms 60 and 80 for precisely positioning the photosensitive member 30 at the image forming position 10 will be described.

Photosensitive member positioning and rotation diving mechanism 60 is attached to the right side wall 1R of the apparatus main body and includes an output axis 70, a driving pin R61 that is rotated integrally with the output axis 70, an output axis driving gear 71 and a driving mechanism for rotating these elements mentioned above. The output axis 70 is supported, movably in the thrust direction and rotatably, by the bearings 77 fixed respectively to the right side wall 1R of the apparatus main body and a base plate 67 fixed to the right side wall 1R.

One end of the output axis 70 has a tip-tapered portion 75, which has a convex tapered surface corresponding to the first tapered hole portion 40A of the first flange 40. The other end of the output axis 70 has a spherical shape so as to be in contact with a thrust bearing 69 with small area. The output axis driving gear 71, which is fixed to the output axis 70, is a left-handed helical gear, having the same direction as the rotation direction. This output axis driving gear 71 meshes with a motor-side gear 72. Numeral 74 denotes a compression spring, which is inserted between the bearing 77 and the output axis driving gear 71. This compression spring 74 constantly urges the output axis 70 and the driving pin 61 toward the position that is separated from the first taper hole portion 40A of the first flange 40. The output axis 70 can move against the spring force by a driving means for moving the thrust bearing 69, between a position separated from the first flange 40 and a position where the first taper hole portion 40A of the first flange 40 engages the tip-tapered portion 75. The motor-side gear 72 has a sufficient tooth width so that the output axis driving gear 71 meshes with the motor-side gear 72 in any position. When the output axis 70 moves in the thrust direction, the output axis driving gear 71 and the motor-side gear 72 slide against each other on the tooth surfaces.

Numeral 61 is a driving pin, which meshes with the first coupling portion 40B so as to transmit power, is fixed to the output axis 70 and is rotated integrally with the output axis 70.

The following is a description of the photosensitive member positioning and rotation driving mechanism 80, which is attached to the left wall 1L of the main body.

The photosensitive member positioning and rotation driving mechanism 80 includes an input axis 81, a driving pin 82 rotating integrally with the input axis 81, a brake means 90, and a mechanism moving the input axis 81 in a thrust direction. The input axis 81 is supported, movably in the thrust direction and rotatably, by the bearings 84 fixed respectively to the left side wall 1L of the apparatus main body and a base plate 83 fixed to the left side wall 1L.

One end of the input axis 81 has a tip-tapered portion 85, which has a convex tapered surface corresponding to the second tapered hole portion 41A of the second flange 41. The other end of the input axis 81 has a spherical shape so as to be in contact with a thrust bearing 86 with a small area. A brake plate 91 is fixed to the input axis 81. Numeral 87 denotes a compression spring, which is inserted between the bearing 84 and a thrust plate 93. This compression spring 87 constantly urges the input axis 81 and the driving pin 82 toward the position that is separated from the second coupling portion 41B of the second flange 41. The input axis 81 can move against the spring force by a driving means for moving the thrust bearing 86, between a position separated from the second flange 41 and a position where the second taper hole portion 41A of the second flange 41 engages the tip-tapered portion 85. The brake plate 91 is rotated integrally with the input axis 81 and rotates a brake pad 92 at the same cycle. The brake pad 92 generates the braking power by being brought into contact with the brake base plate 95 fixed to the left side wall 1L of the apparatus main body when the tip-taper portion 85 of the input axis 81 engages the second taper hole portion 41A of the second flange 41. On the other hand, when the tip taper portion 85 of the input axis 81 does not engage the second taper hole portion 41A of the second flange 41, the brake pad 92 is not in contact with the brake base plate 95, and thus the braking power is not generated. Between the brake pad 92 and the brake plate 91, the compression spring 94 is inserted, thus generating an appropriate brake torque when the brake pad 92 is in contact with the brake base plate 95.

Numeral 82 denotes a driving pin, which meshes with the second coupling portion 41B of the second flange 41, and conveys the rotation power of the photosensitive member 30 to the brake means 90. The driving pin 82 is fixed to the input axis 81 and is rotated integrally with the input axis 81.

[Operation of Photosensitive Member Positioning and Rotation Driving Mechanism]

Next, the following is a description of the operation of the photosensitive member positioning and rotation driving mechanism.

First, the positioning operation will be described. When the image forming unit 3 has been shifted to the image forming position 10 in the apparatus main body 1, the driving pin 61 of the photosensitive member positioning and rotation driving mechanism 60 and the output axis 70 having the output driving gear 71 moves in the thrust direction by the thrust bearing 69. At the engaging position, the tip-taper portion 75 of the output axis 70 is positioned corresponding to a first hole portion 40A of the first flange 40. At the same time, the first coupling portion 40B of the first flange 40 engages the driving pin 61. Input axis 81 having a driving pin 82 of the rotation driving mechanism 80 provided on the left side wall 1L of the apparatus main body moves in the thrust direction by the thrust bearing 86 in synchronization with the motion of the output axis 70, and tip taper portion 85 of the input axis 80 is positioned corresponding to the second taper hole portion 41A of the second flange 41 at the engaging position and at the same time, the second coupling portion 41B of the second flange 41 engages the driving pin 82. Thus, the positioning operation is finished.

Next, the rotation driving operation of the image forming unit located at the image forming position will be described. When the motor-side gear 72 is rotated by the driving source of the apparatus main body 1, the rotation force is conveyed to the first coupling portion 40B of the first flange 40 via the output driving gear 71, the output axis 70 and the driving pin 61, so as to drive to rotate the photosensitive member 30. On the other hand, the brake plate 91 that is integrally formed with an input axis 80, a spring 94 and a brake pad 92 are rotated via the second coupling portion 41B of the second flange 41, the driving pin 82 and the input axis 80. Thus, the brake power is generated between the brake pad 92 and the brake base plate 95. As a result, the photosensitive member 30 rotates stably regardless of the rotation of the developing roller 35A.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An image forming unit comprising a photosensitive member on the surface of which an electrostatic latent image is formed, a charger for charging the photosensitive member, a developing means for developing the electrostatic latent image into a visible image, and a box for supporting the photosensitive member, the charger and the developing means, wherein a first flange that is integrally formed into one unit including a positioning part with respect to the image forming apparatus main body for positioning the photosensitive member at the image forming position of the image forming apparatus main body and a rotation engaging portion for receiving a rotation driving force from the image forming apparatus main body is attached to at least one end of the photosensitive member.

2. The image forming unit according to claim 1, wherein the positioning part is a hole or a concave portion provided concentrically with respect to the photosensitive member axis.

3. The image forming unit according to claim 1, wherein a second flange that is integrally formed into one unit including a positioning part for positioning with respect to the image forming apparatus main body is attached to the other end of the photosensitive member opposing to the first flange.

4. The image forming unit according to claim 3, wherein the second flange is provided with a rotation engaging portion for conveying the rotation driving force from the image forming apparatus main body.

5. The image forming unit according to claim 3, wherein at least one of the first flange and the second flange is made of a conductive material.

6. The image forming unit according to claim 3, wherein both ends of the photosensitive member are rotatably bearing supported by the box in the outer circumference of the first and second flanges.

7. The image forming unit according to claim 6, wherein the bearing supporting portions for supporting the first and second flanges formed in the box are formed in approximately U-shaped grooves having a thickness that is larger than an outer diameter of the part of the first and second flanges that is bearing supported.

8. The image forming unit according to claim 1, wherein the rotation engaging portion of the first flange is concave and convex surface formed on one end face of the first flange and the concave and convex surface is located at the outer-most side portion.

9. The image forming unit according to claim 8, further comprising a cover that has substantially the same height as the rotation engaging portion of the first flange and protects the first flange.

10. An image forming apparatus comprising:

a plurality of image forming units for different colors having a photosensitive member, an image forming unit conveying means for switching the plurality of image forming units by moving them successively between an image forming position and a waiting position, a positioning means for positioning the photosensitive member at a predetermined image forming position, an exposure means for exposing the photosensitive member;

a transfer means for transferring sequentially the toner images of many colors, which are formed on the photosensitive member, to form a toner image in which toner images of a plurality of colors are overlapped on the photosensitive member, and a rotation driving means for driving to rotate the photosensitive member and the transfer means, wherein an image forming unit according to claim 3 is used as the image forming unit.

11. The image forming apparatus according to claim 10, wherein at least one of the positioning means and the rotation driving means is made of a conductive material that is in contact with and conducts to the first flange or second flange.

12. The image forming apparatus according to claim 10, further comprising a brake means for providing the photosensitive member with a braking power via the second flange.

13. The image forming unit according to claim 1, wherein at least one end of the photosensitive member is rotatably bearing supported by the box in the outer circumference of the first flange.

* * * * *